US006634460B1

(12) United States Patent
Hackenberg

(10) Patent No.: US 6,634,460 B1
(45) Date of Patent: Oct. 21, 2003

(54) COUNTER FOR PRESENTING AND/OR SELLING GOODS

(75) Inventor: Dieter Hackenberg, Witten (DE)

(73) Assignee: Vieler International KG, Iserlohn (DE)

( * ) Notice: Subject to any disclaimer, the term of this patent is extended or adjusted under 35 U.S.C. 154(b) by 0 days.

(21) Appl. No.: 09/913,251

(22) PCT Filed: Feb. 15, 2000

(86) PCT No.: PCT/EP00/01210

§ 371 (c)(1),
(2), (4) Date: Aug. 10, 2001

(87) PCT Pub. No.: WO00/49200

PCT Pub. Date: Aug. 24, 2000

(30) Foreign Application Priority Data

Feb. 16, 1999 (DE) ..... 199 06 395

(51) Int. Cl.[7] ..... A63F 9/02

(52) U.S. Cl. ..... 186/59; 186/38; 312/138.1

(58) Field of Search ..... 186/52, 59, 38; 74/469, 490.15; 312/114, 138.1, 139, 139.1, 139.2, 140, 140.4

(56) References Cited

U.S. PATENT DOCUMENTS

| | | | | | |
|---|---|---|---|---|---|
| 425,891 | A | * | 4/1890 | Lehnbeuter | 312/138.1 |
| 790,135 | A | * | 5/1905 | Jaeger | 312/138.1 |
| 4,842,349 | A | * | 6/1989 | Stenemann | 312/116 |
| 5,112,118 | A | * | 5/1992 | Wiehle | 312/116 |
| 5,116,274 | A | * | 5/1992 | Artwohl et al. | 312/116 |
| 5,810,460 | A | * | 9/1998 | Hansen | 312/139 |

FOREIGN PATENT DOCUMENTS

| | | | | |
|---|---|---|---|---|
| DE | 2603425 | | 8/1977 | A47F/3/04 |
| DE | 33 13 914 | A1 * | 10/1984 | A47F/3/12 |
| DE | 3503340 | | 8/1986 | A47F/3/04 |
| DE | 36 39 214 | A1 * | 5/1988 | A47F/3/00 |
| DE | 36 39 215 | A1 * | 5/1988 | A47F/3/00 |
| DE | 3901831 | | 7/1990 | A47F/3/00 |
| DE | 42 34 945 | A1 * | 4/1994 | A47F/3/04 |
| GB | 2245155 | | 1/1992 | A47F/3/04 |

* cited by examiner

*Primary Examiner*—Donald P. Walsh
*Assistant Examiner*—Mark J. Beauchaine
(74) *Attorney, Agent, or Firm*—Friedrich Kueffner

(57) ABSTRACT

The invention relates to a counter (10) for presenting and/or selling goods. The aim of the invention is to provide a means of displacing a module consisting of a system of joint mechanisms (22) which are associated with a glass pane (21) by means of fixing elements (23) between a closed position (20) in which the inside of the counter (13) is covered and an open position (20') in which it is exposed. Said joint mechanisms (22) are mounted on the supports (15) of the counter (10) in such a way that they can pivot about a horizontal pin (18). In order to ensure that the modular unit is secure in the open position (20') the joint mechanism (22) is provided with an extended arm (24) which has the swivel bearing (18) on its lower arm section. During the transition from the closed position (20) to the open position (20'), the center of gravity (27) of the module in relation to the swivel pin (18) moves to the opposite side (27'). In the closed position (20), the pane (21) is subjected to a torque which acts in the closing direction. In the open position (20'), a torque acts on the pane (21) in the opening direction. The pane (2) can no longer fall back out of the open position (20') into the closed position (20) uncontrollably.

9 Claims, 10 Drawing Sheets

COUNTER FOR PRESENTING AND/OR SELLING GOODS

BACKGROUND OF THE INVENTION

1. Field of the Invention

The invention relates to a counter. The body of the counter has a support surface on which goods are displayed which, on the side facing the customer, are usually covered by a glass pane. Within the body of the counter the lower ends of supports are fastened. Above the body of the counter, a glass pane is provided which can be pivoted about a horizontal axis between a closed position covering the goods on the support surface of the body of the counter, on the one hand, and an open position allowing access to the goods, on the other hand. Joint members are connected by means of a pivot bearing with the support and project at the support end where they have securing means for a glass pane. The joint members with the glass pane fastened on its securing means form a modular unit which is pivotable about a horizontal axis defined by the pivot bearings between a closed position covering the goods on the support surface and an open position allowing access to the goods. The joint member has an extension arm which—viewed in the closed position—extends in the longitudinal direction of the support. Upon pivoting of the modular unit from its closed position into its open position, the center of gravity of the modular unit is moved from an initial position located on one side relative to the pivot axis into an end position located on the oppositely positioned side of the pivot axis. A parallelogram linkage is provided between the glass pane and the body of the counter and is comprised of a pivot arm and a guide member. The first ends of the pivot arm and of the guide member, at a spacing to one another, are connected to the glass pane and are movable together with the glass pane. The second ends of the pivot arm and of the guide member, also at a spacing to one another, are connected stationarily on the support of the body of the counter in a pivotal way.

2. Discussion of Related Art

Counters are known (DE 35 03 340 A1) in which the glass pane is pivotably supported by means of a swivel head at the upper end portion of the support. From the closed position, the glass pane can be pivoted into an open position as far as permitted by the support. In the open position, the center of gravity of the modular unit is still positioned on the same side relative to the pivot bearing. Moreover, provisions are to be made in order to secure the open position of the modular unit and to prevent an accidental closing of the modular unit. The course of the pivot movement of the modular unit can be controlled by control members. A rod-shaped force storage device, such as a gas spring, arranged in the interior of the hollow profile is used as a control member, wherein the upper rod end of the gas spring is connected to the swivel head and the lower rod end is stationarily connected in the interior of the hollow profile of the support.

In the known counter (DE 41 10 942 A1), between the glass pane and the body of the counter a parallelogram linkage is arranged which is comprised of a pivot arm and a guide member. The respective ends of the pivot arm and of the guide member, spaced at a distance by to one another, are connected, on the one hand, to the glass pane and, on the other hand, stationarily on the support in a pivotable way. By means of this parallelogram linkage the center of gravity of the pivotable parts in the open position can be moved to such an extent that, relative to the initial position in the open position, it is located on the opposite side of the pivot axis. Accordingly, a torque acts in the opening direction on the glass pane. Accordingly, constructively an uncontrolled closing of the pivotable parts is prevented. The movement of the center of gravity during opening and closing of the glass pane requires a considerable force expenditure, in particular, during acceleration at the beginning of the pivot movement as well as during braking at the end of the pivot movement. This acceleration and braking work is provided manually by the user. This work, in particular, for large glass panes which are very heavy, is very great. Control members for the course of the pivot movement have not been provided. To provide them in the form of gas springs would be difficult in the case of the known parallelogram linkages. They would be space-consuming and would impair the pleasant appearance of the counter.

SUMMARY OF THE INVENTION

The invention has the object to develop an attractive counter of the aforementioned kind such that its handling during opening and closing of the glass pane is easily carried out. This is achieved according to the invention in that the course of the pivot movement of the glass pane is determined by control members which are comprised of a force-loaded push member and are guided along the support, in that between the pivot arm and the push member a linkage is arranged which converts the pivot movement of the linkage arm into a longitudinal movement of the push member, and in that the push member is loaded by two independent forces, wherein one force load acts in the closed position of the glass pane and the other acts in its open position onto the push member.

Because the joint member is extended by an arm, having arranged at its lower arm area the pivot bearing, the center of gravity of the modular unit during pivoting into the open position can be displaced so far that, relative to the initial position in the closed position of the modular unit, it reaches a position on the opposite side of the pivot axis. Accordingly, a torque acts on the glass pane in the opening direction. This means that already by means of this constructive measure an uncontrolled closing of the modular unit from the open position is prevented. There is no risk of injury. According to the invention, mounting and manipulation of space-requiring measures for securing the open position are no longer needed.

Inasmuch as, the pivotable modular unit is a structure that is rigid within itself, according to the invention a substantially greater pivot angle between the open position and the closed position is also obtained as a result of the arm extending the joint member. In the open position, the free end of the glass pane is pivoted away to such an extent that the support surface of the body of the counter is entirely exposed and especially easily accessible.

Another possibility of special inventive importance resides in that the modular unit is comprised of two partial modular groups which are movable relative to one another.

In this connection, it is recommended to provide a horizontal rotary axis between the two partial modular groups as well as a guide member which upon pivoting of the modular unit generates a rotation of the glass pane which is superimposed on the pivot movement. The goal is a defined open position of the glass pane where the free edge of the glass pane has a position according to certain requirements.

Such a requirement can be, in particular, to transfer the free edge of a curved glass pane, which is referred to as a "panoramic pane", in the open position into a position where it extending shortly above the supports and is substantially horizontal. In this connection, the edge of the glass pane is also a so-called "spit protection" for the goods that are present on the support surface of the body of the counter. This is, in particular, suitable when employing the counter for self-service by customers where the customers themselves can remove the goods from the counter. The edge of the glass pane then acts as a roof which partially covers the support surface of the counter. In the open position the counter according to the invention has an especially pleasing appearance; it has an elegant appearance in comparison to counters with a rigid modular unit frame. As a result of the rotary axis between the two partial modular units the glass pane can rotate back upon pivoting.in the counter direction. The free end of the glass pane in this open position does not reach extremely high positions. Accordingly, the rooms where such a counter according to the invention is positioned does not require a high ceiling. Moreover, gripping the free edge of the glass pane, positioned in the open position, of the counter according to the invention is comfortably possible for the purpose of moving the modular unit back into the closed position.

In order to facilitate the course of the pivot movement of the modular unit during the transition from the closed position to the open position, force-loaded control members are used. They can be realized in three simple ways.

Further measures and advantages of the invention result from the dependent claims, the subsequent description, and the drawings. In the drawings the prior art as well as several embodiments of the invention are illustrated. It is shown in:

BRIEF DESCRIPTION OF THE DRAWINGS

Further measures and advantages of the invention result from the subsequent description, and the drawings. It is shown in.

DESCRIPTION OF PREFERRED EMBODIMENTS

Figure 1:
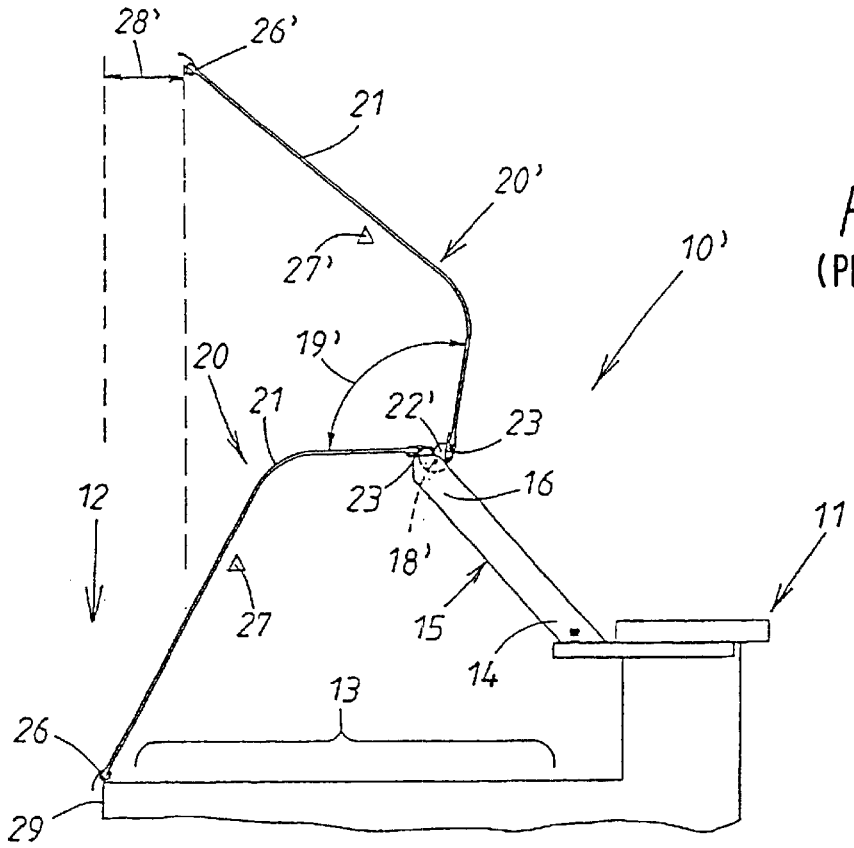
FIG. 1 (PRIOR ART)
FIG. 1 a schematic side view of a counter according to the prior art, in the closed position as well as in the open position of a modular unit comprising the glass pane.
Figure 2:
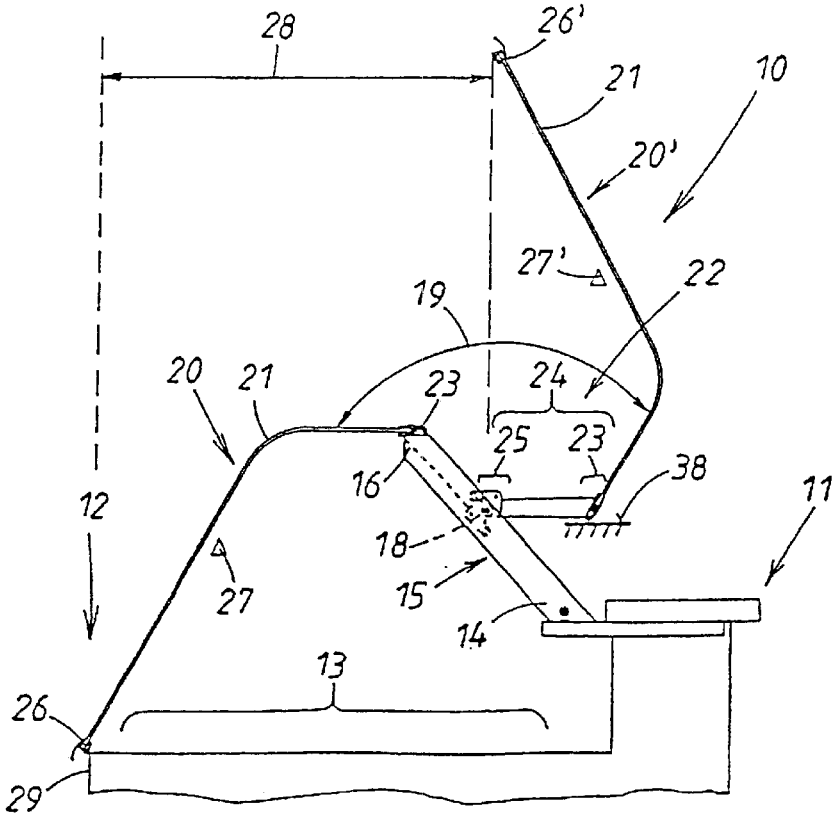
FIG. 2 in a representation corresponding to FIG. 1, the closed position as well as the open position of the modular unit of the counter according to the invention, wherein the modular unit is embodied as a modular unit which is rigid in itself.
Figures 10, 11:
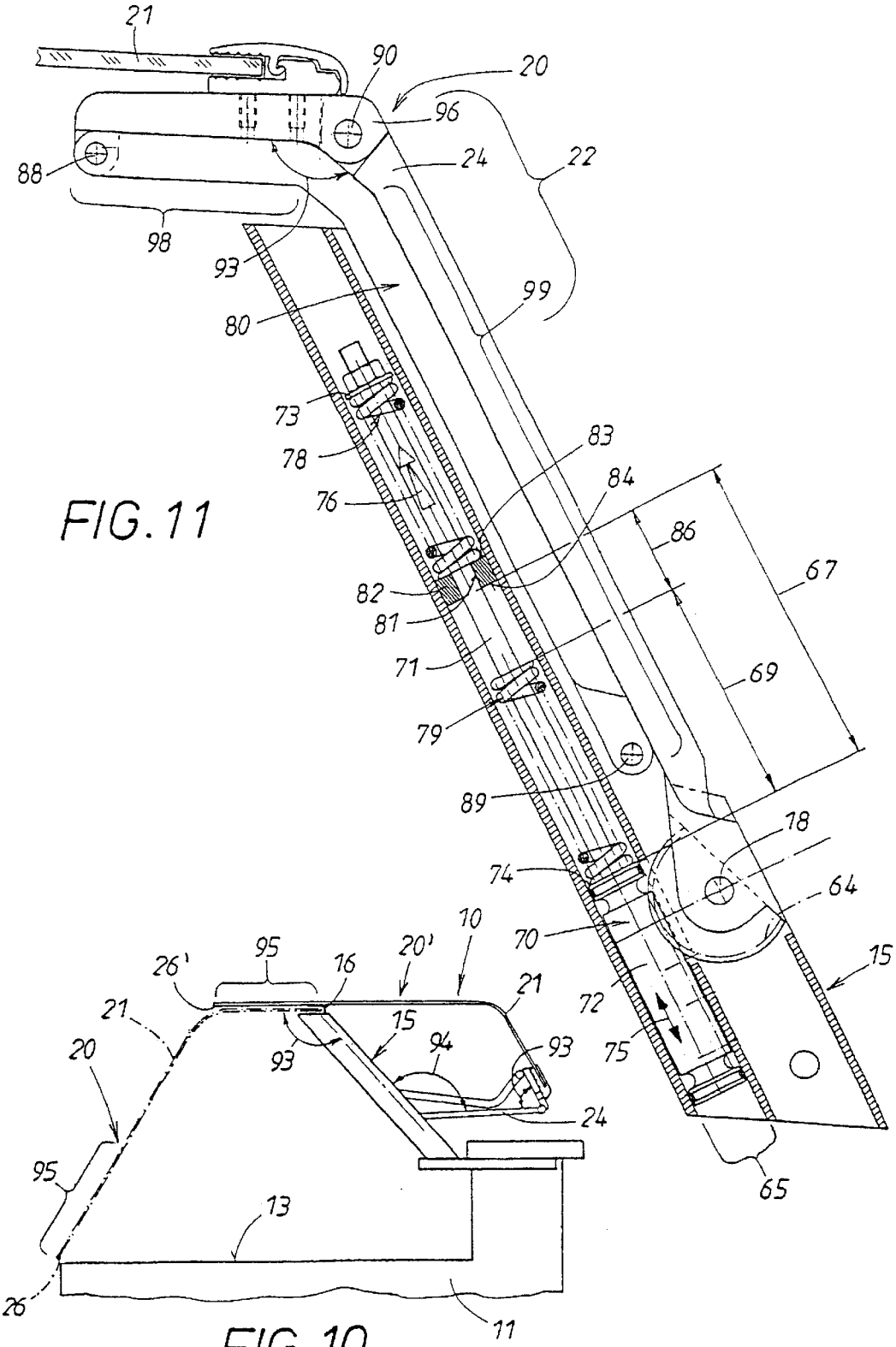
FIG. 10 a schematic side view corresponding to FIG. 2 of a third embodiment of the counter according to the invention where the closed position as well as the special open position of the modular unit are illustrated, which modular unit is comprised of two oppositely movable partial modular groups.
FIG. 11 a partial portion of the third embodiment of the counter shown in FIG. 10, the modular unit being in the closed position, wherein the profiled wall of the support facing the viewer is broken away.

In FIG. 1 a counter 10' according to the prior art is illustrated, while FIG. 2, on the one hand, and FIG. 10, on the other hand, in a similar illustration, show the inventive counters 10. Both the known and the inventive counters 10, 10' have, in principle, the following identical configuration. They have a body 11 of the counter which, toward the side 12 facing the customer, has a support surface 13 for goods, not illustrated in detail. This support surface 13 is normally covered by a glass pane 21. This glass pane 21 is part of a modular unit 20 which in the prior art comprises a joint member provided in the form of a swivel head 22' which engages by means of a securing means 23 the upper edge of the glass pane 21. According to the invention, the joint member 22 is of a more complex configuration which will be explained in more detail.

Figures 3, 4, 5:
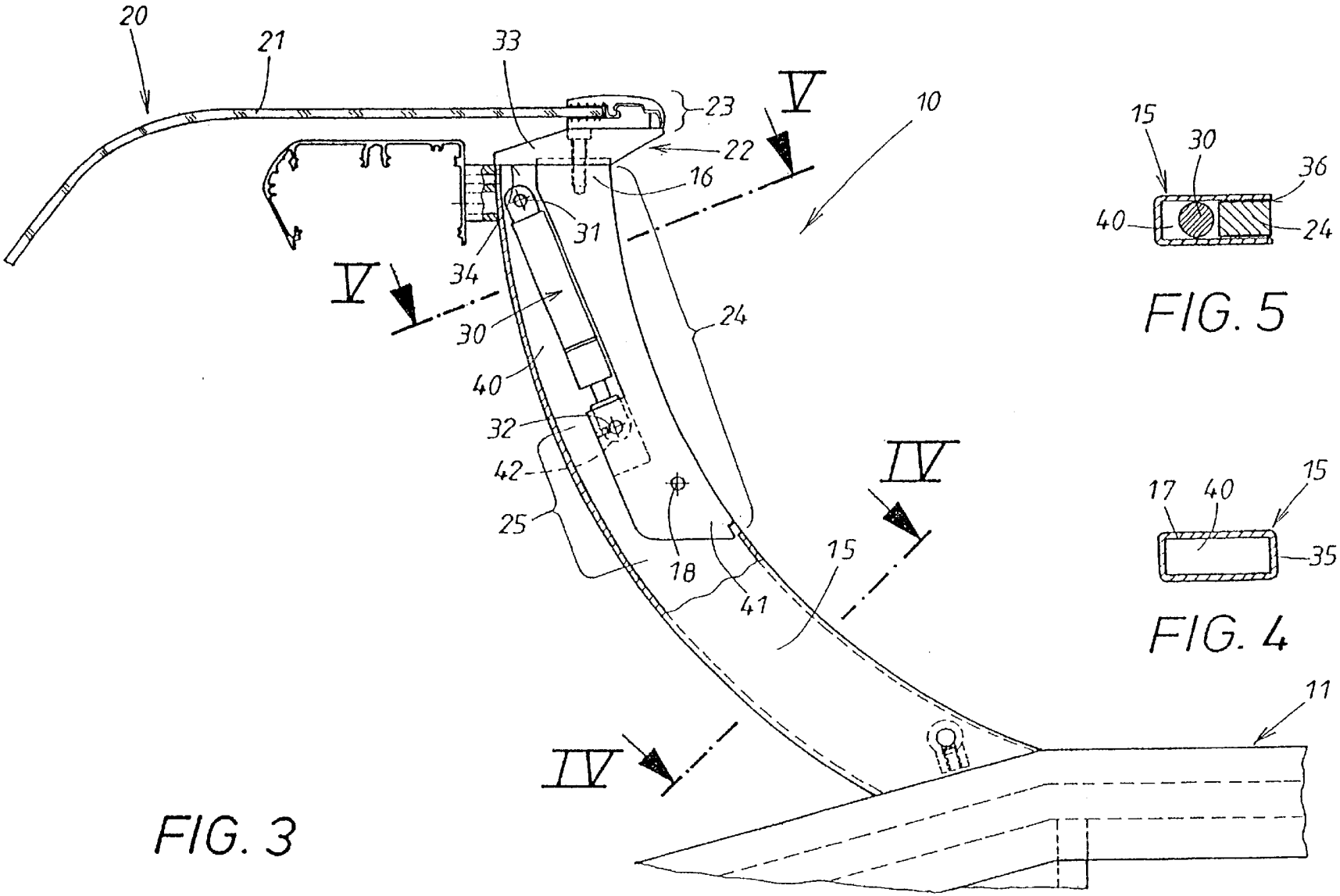
FIG. 3 the upper partial portion of a first embodiment of the counter according to the invention in the closed position, where the profiled wall facing the viewer is partially broken away from the hollow profile of the support.
FIGS. 4+5 show cross-sections of the support shown in FIG. 3 along the section lines IV—IV, V—V.

The identical configuration of the two counters 10', 10 of FIG. 1, on the one hand, and FIG. 2. as well as 10, on the other hand, resides moreover in that in the body of the counter 11 the lower ends 14 of supports 15 are fastened which have, for example, a hollow profile 17 as illustrated in FIG. 4. The hollow profile 17 in the present case has a rectangular shape. When the glass pane 21 is positioned in the first position illustrated in FIGS. 1 and 2 as well as 10, the joint members 22 or 22' with their holding means 23 project from the upper end 16 of the support in both cases. The joint members 22 or 22' are supported by pivot bearings 18 or 18' on the support. These pivot bearings 18 and 18' determine a horizontal pivot axis for a modular unit 20 comprised of the glass pane 21, the respective joint member 22 and 22', and the securing means 23. Accordingly, the modular unit can be pivoted about a pivot angle 19' and 19 from its aforementioned closed position 20, in which it covers the support surface 13, into its open position 20' of FIGS. 1 and FIG. 2 as well as 10 in which the support surface 13 is exposed to a greater or lesser degree.

Firstly, the first and second embodiments of the invention according to FIG. 2 through FIG. 9 are to be compared with the prior art according to FIG. 1. In this case, the modular unit 20 is a structure which is rigid in itself and in which all elements carry out the same angular travel between the closed position 20 and the open position 20' upon being pivoted. This rigid structure in the following is referred to as "modular unit" in order to distinguish it from the movable modular unit of the third embodiment of the invention as illustrated in FIGS. 10 through 14. In the third embodiment, two partial modular units carry out a rotational movement relative to one another during pivoting, which will be described in the following.

Firstly, the rigid modular unit according to FIG. 1 of the prior art and FIGS. 2 through 9 of the two first embodiments of the invention will be explained in more detail. In the closed position 20 of the modular unit the free end 26 of the glass pane which is provided with suitable sealing means is, as much as possible, in contact with the end of the support surface 13 at 29. In the open position 20' of the modular unit in both cases, as can be seen in FIGS. 1 and 2, the end of the glass pane is in an elevated position 26' which, however, is very different in both cases. The same holds true for the center of gravity of the modular unit which in the closed position is identified by 27 in both FIGS. and reaches the position 27' in the elevated position 20'.

In the known counter 10' of FIG. 1 the joint member formed by the swivel head 22 allows only a limited pivot angle 19'. In the open position 20' of FIG. 1, the end 26' of the glass pane, viewed in a vertical projection, is still positioned above the forward area of the support surface 13 facing the customer side 12. In the direction of extension of the width of the counter of FIG. 1, the free end 26 of the glass pane has been moved from its initial position in the closed position 20 of the modular unit, viewed from the forward edge 29 of the counter, only by a relatively small horizontal travel distance 28' to its end position 26' in the open position. When self-service is provided and a customer in this case wants to have access to the goods on the support surface 13, his degree of freedom of movement is very limited. The center of gravity 27' of the modular unit in the open position 20' is located on the side facing the forward edge 29 of the counter. Because the center of gravity 27' has a tendency to attempt to reach its lowest possible position, measures must be taken in regard to the known counter 10' so that the glass pane 21 will not itself accidentally return from its open position 20' into the closed position 20 and thereby cause injury to the customer leaning over the support surface 13. This danger no longer exists for the counter 10 according to the invention, as can be seen with the aid of FIG. 2.

The basic configuration of the counter 10 according to the invention can be explained best in connection with FIG. 3. The joint member 22 according to the invention is fixedly provided.with an extension arm 24 which extends in the direction of length of the support 15 when the closed position of the modular unit 20 illustrated in FIG. 3 is present. In the closed position 20 the joint member 22 projects from the upper support end 16 wherein a support nose 33 on the joint member 22 comes to rest against the upper end face 34 of the support 15. The support 15 is arc-shaped in the case of FIG. 3. The aforementioned pivot bearing 18 of the support member 22 is arranged at the lower arm area 25 of the extension arm 24 and displaced relative to the upper support end 16. The pivot bearing 18 in this case is positioned approximately in the central area of the available support length. As can be seen best in the illustrated open position 20' of the modular unit of FIG. 6, the rear wall 35 of the hollow profile 17 facing away from the goods support surface 13 is provided with a cutout 36 which extends at least across the end portion 3.7 of the support 15 located above the pivot bearing 18. This cutout 36 is however covered in the closed position 20 of the modular unit illustrated in FIG. 3 by the extension arm 24. The extension arm 24 completes the hollow profile in the closed form shown in FIG. 5.

Figure 6:
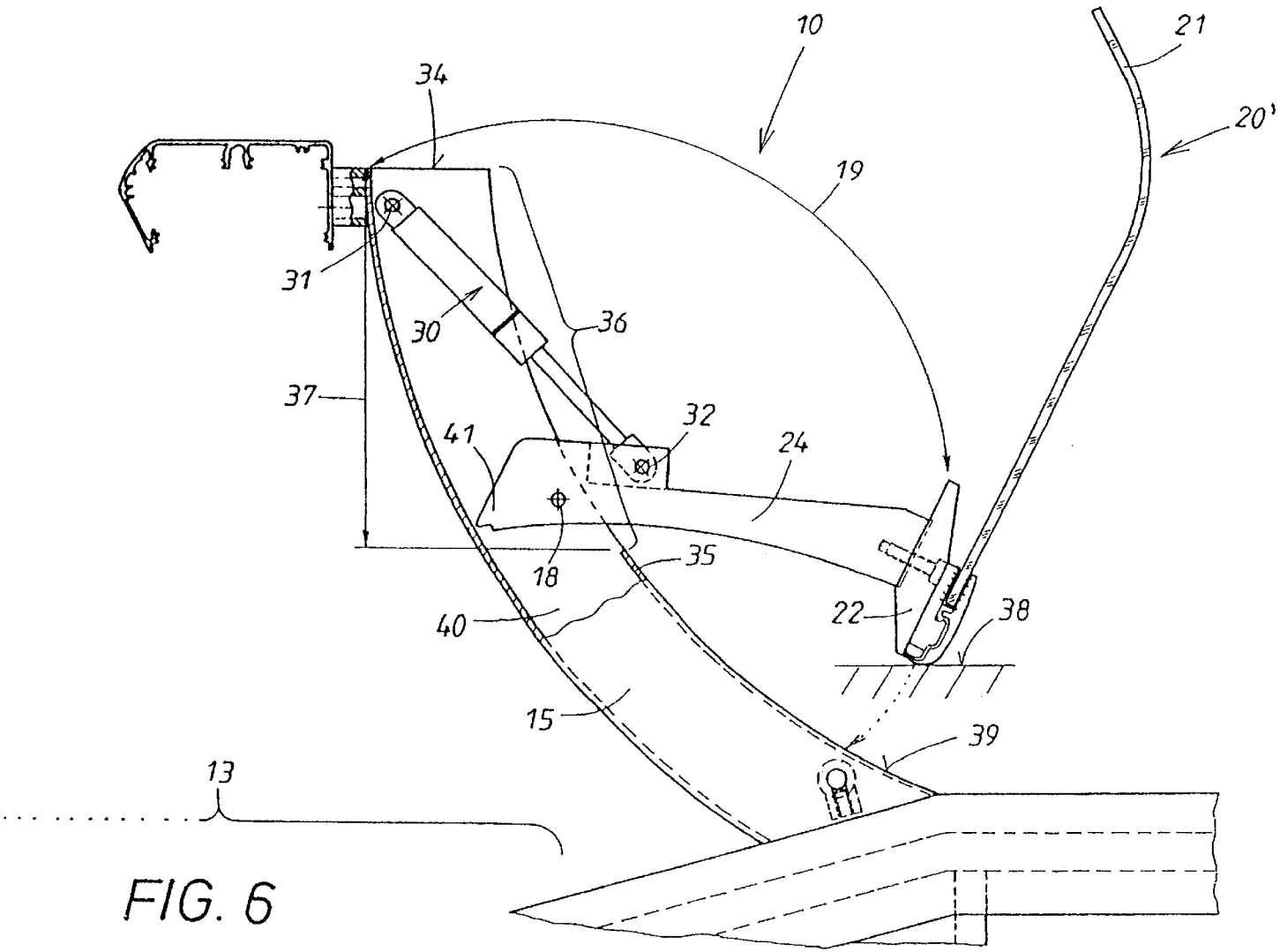
FIG. 6 in a representation corresponding to FIG. 3 the open position of the modular unit of this counter.

When pivoting into the open position, according to FIG. 6, the extension arm 24 moves through the profile cutout 36 outwardly until the joint.member 22 comes to rest against a support surface 38 of the body 11 of the counter or even against the outer surface 39 of the rearward profile wall 39 of the support 15 which is without cutout. A very large pivot angle 19 is present according to FIG. 6 or FIG. 2. When comparing the conditions of FIG. 2 with the afore described conditions of FIG. 1, the following important difference can be seen. In the counter 10 according to the invention, the center of gravity 27' in the open position 20' of the modular unit is located on the side which is positioned opposite the forward edge 29 of the counter relative to the horizontal pivot axis 18. In the open position, a torque in the direction of opening is thus generated in the modular unit 20' of the counter 10 according to the invention so that an accidental closing of the glass pane 21 is prevented. The already mentioned support surface 38, according to FIG. 2, thus also receives this further opening moment of the open modular unit 20'. Viewed in a vertical projection, the center of gravity 27' of the counter 10 is located at the rearward end of the support surface 13 or even at a location beyond the support surface. Relative to the initial position 26 in FIG. 2, the free end of the glass pane of the counter 10 has moved by a very large horizontal travel distance 28 up to its end position 26' in the open position 20'. When viewed from the customer side 12, a comfortable access to the goods on the support surface 13 of the counter 10 is possible.

Different control members can be used for the counter 10 which control the course of the pivot movement 19. In the first counter 10 according to the invention illustrated in FIGS. 3 to 6, there is provided a rod-shaped, length-adjustable dampening device 30 of a configuration known in the art. In the closed position 20 of FIG. 3, the dampening device 30 is positioned adjacent to the extension arm 24 and extends in its longitudinal direction. This is also illustrated in the sectional view of FIG. 5. The upper rod end 31 is stationarily connected within the interior 40 of the hollow profile of the support 15. The lower rod end 32, on the other hand, is pivotably secured in the lower arm area 25 of the extension arm 24 so as to be entrained and therefore can be moved out of the cutout 36 during pivoting according to FIG. 6. The extension arm 24 is formed, relative to its pivot bearing 18, as a two-arm lever which, according to FIG. 3, covers in the closed position 20 with its end piece 41 the portion of the profile cutout 36, shown in FIG. 6, positioned underneath the pivot bearing 28.

In the open position 201 the end piece 41 pivots, as illustrated in FIG. 6, into the interior 40 of the hollow profile. The connecting location of the lower rod end 32 which can be entrained is, connected at the step-shaped shoulder,32 at the lower arm area 25, as illustrated in FIG. 3. This step 42 makes possible the space-saving arrangement of the dampening device 30 closely adjacent to the extension arm 24 in the closed position 20 of FIG. 3.

Figure 7:
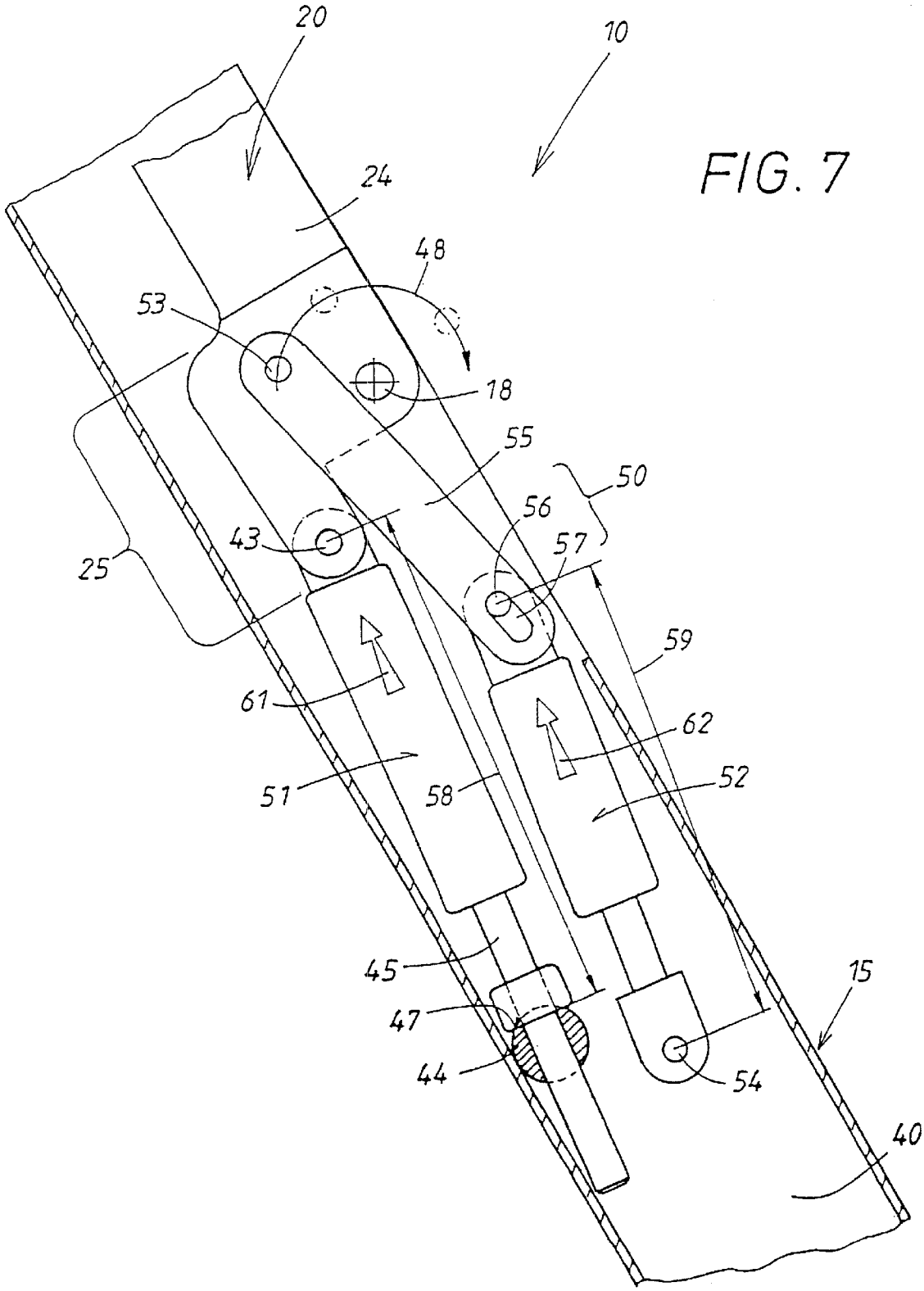
FIG. 7 a central partial portion of the support of a further embodiment of the counter according to the invention where the wall facing the viewer is broken away from the hollow profile of the support and the modular unit in this case is also embodied as a modular unit rigid in itself and is in its closed position.
Figure 8:
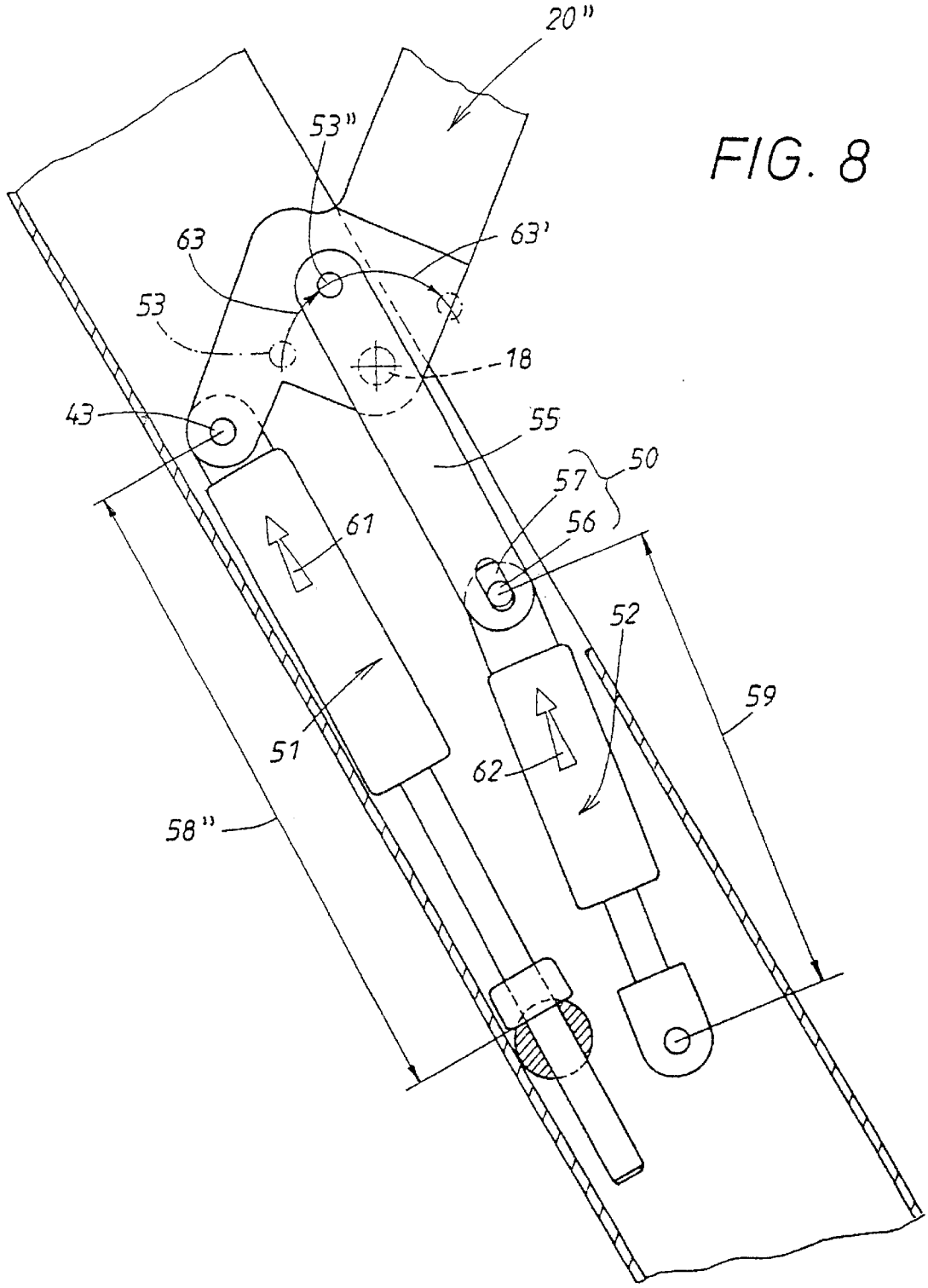
FIG. 8 in a position corresponding to FIG. 7 the same counter according to the invention when the modular unit is in transition from its closed position into its open position.
Figure 9:
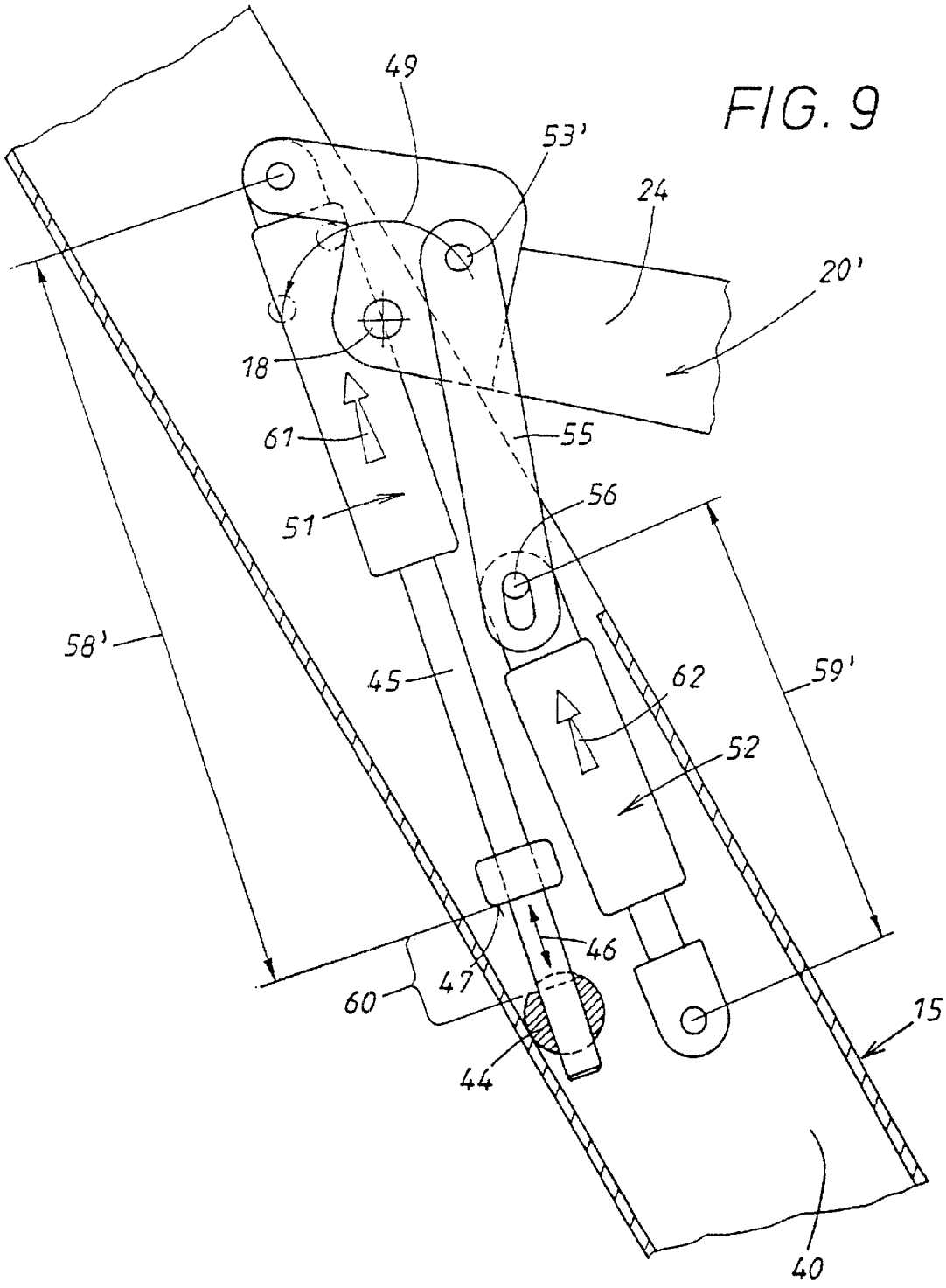
FIG. 9 the same conditions for this counter when the open position of the modular unit has been reached.

In FIGS. 7 through 9 a slightly modified second embodiment of the counter 10 according to the invention is illustrated in three positions, particularly, only with the aid of those components which have been modified in comparison to the first embodiment of the invention of FIGS. 2 through 6. The components which are analog to the previous embodiments are identified with the same reference numerals so that in this respect the preceding description applies. Therefore, only the differences must be explained.

In FIG. 7, the closed position 20 of the modular unit is illustrated. In this case two rod-shaped control members 51, 52 are provided which are formed as force storage devices in the form of gas springs. They extend approximately as an extension of the extension arm 24 of FIG. 7. One of the force storage devices 51 serves in this connection as an opening aid in the direction of the opening movement arrow 48 of FIG. 7, while the other force storage device 52 supports the opposite movement for closing illustrated by the movement arrow 49 in FIG. 9. In the present case, the force storage device 51 acting as an opening aid is connected directly at 43 in the lower area 25 of the extension arm 24. The corresponding point of attack 53 in this arm area 25 of the force storage device 52 functioning as the closing aid, on the other hand, is realized indirectly, by means of a linkage, which is comprised of a simple lever 55. This lever 55 is connected at 53, and the other end of the arm is connected by a sliding block guide 50 to the force storage device 52. This sliding block guide 15 is comprised of a slotted hole 57within the lever 55 which is engaged by a bearing pin 56 of the upper end of the force storage device 52. The lower end of the force storage device 52 is stationarily connected at 54 within the interior 40 of the profile.

The force storage device 51 acting in the opening direction has a stationary point of attack 44 which is formed in a special way within the interior 40 of the hollow profile of the support 15. In the closed position in FIG. 7 the force storage device 51 has a minimal insertion length 58 wherein it is imparted with a minimal spring force that is illustrated by the force arrow 61. The force storage device 51 has a push rod 54 which penetrates in a longitudinally slidable way, as illustrated in FIG. 9, a penetration in the correlated point of attack 44 but is supported in the closed position 20 by a strip-shaped shoulder 47 at the support location. The spring force 61 is thus utilized in the aforementioned opening movement 48 of the modular unit; lifting of the center of gravity 27 illustrated in FIG. 2 is thus facilitated. In the closed position 20 of FIG. 7, the other force storage device 52 has its maximum extension length illustrated at 59 in FIG. 7. Even though a spring force 62 in the extension direction is active also for the force storage device 52, it cannot result in a further extension of the extension length 57 because of the inner stops.

In FIG. 8, an intermediate position 20" of the modular unit is illustrated. The force storage device 51 has a greater extension length 58". During the movement 63 the aforementioned point of attack of the lever 55 belonging to the other force storage device 52 has moved farther into the intermediate position 53" wherein a change of the corresponding maximum extension length 59 of this force storage device 52 must not yet have taken place. In this case, the spring force 62 stored within the force storage device 52 has not yet become active up to the intermediate position 20" of FIG. 3. This is so because of the sliding block guide 50 between the lever 55 and the force storage device 52. The aforementioned bearing pin 56 has moved into the lower area of the slotted hole 57. In this intermediate position the center of gravity 27 explained in connection with FIG. 2 has reached approximately the apex of the opening pivot movement aligned with the pivot bearing 18.

During the course of the further movement of the modular unit illustrated in FIG. 8 by an arrow extension 63', the apex is lowered increasingly. Accordingly braking of the further opening pivot movement of the modular unit is desirable. This is realized in that the lever 55 in the sliding block guide 50 impacts with the upper end of its slotted hole 57 on the bearing pin 56 and thus tensions the force storage device 52. This is realized along the travel from the intermediate position 20' of FIG. 8 into the fully open position 20' of the modular unit of FIG. 9. Now the upper connecting location of the lever 55 has reached the end position 53' illustrated in FIG. 9.

Now the force storage device 52 has reached its minimal insertion length 59' which, relative to the intermediate position 58" illustrated in FIG. 8, may have grown still but in the last phase of the further movement 63' of FIG. 8 substantially has no longer been effective. Now the aforementioned longitudinal movement 46 of the shoulder 47 of the push rod 45 belonging to the first force storage device 51 is moved away from the point of attack 44 in the support 15. There is a free spacing 60 between the cooperating support locations 44, 47. The aforementioned spring force 61 is no longer effective by means of the stops within the force storage device 51 in the last opening movement of the modular unit. The torque acting on the modular unit is used instead for tensioning the other force storage device 52 whose spring force 62 thus increases.

The tensioned force storage 52 of FIG. 9 can act as a closing aid during the closing movement 49 of the modular unit, which has been mentioned already and is illustrated in FIG. 9. The increased spring force 62 of the force storage device 52 is effective during lifting of the center of gravity 27 illustrated in FIG. 2 up to the apex of its circular movement. The second force storage device 52 which in FIG. 9. still has its minimal insertion length 59' slowly is transferred to the maximum extension length 29, already described and illustrated in FIG. 8, and lifts thus by means of the pivot pin 56 of its lever 55 the extension arm 24 of the joint member of the modular unit. The force storage device 52 acts now as a closing aid in the initial phase of the closing movement 49. The other force storage device 51 does not impair this because in the initial position the aforementioned free spacing 60 between its support locations 44, 47 is present. This changes only when approximately the situation of FIG. 8 and primarily of FIG. 7 occurs. Then the length of this first force storage device 51 across 58" up to the above described minimal insertion length 58 is shortened. Therefore, again a braking movement occurs in the last phase of the closing movement 49. The center of gravity 27 which is lowered in the direction toward the closed position 20 of FIG. 2 produces a closing torque which, at least in the last phase of its closing movement 49 of FIG. 9, is consumed by a renewed tensioning of the force storage device 51.

Accordingly, the invention not only is characterized by a comfortable opening and closing of the modular unit but also by a corresponding braking of these movements 48, 49. Accordingly, the force storage devices 51, 52 according to the invention have a double function. With a suitable linkage configuration between the extension arm 24 of the joint member 52 according to the invention and the support 40, the force storage devices 51, 52 automatically become active in the desired direction of action.

In the third embodiment according to FIGS. 10 through 14 two independent measures are important with regard to the invention. The first measure is comprised of an especially simple space-saving configuration of the control members, which will be explained first. The other feature concerns the special configuration of the modular unit comprised of two partial compounds that are movable relative to one another, which will be explained in more detail with the aid of FIG. 13. Despite their deviating configuration of the corresponding modular units, the same reference numerals will be used for corresponding components as in the previous embodiment, according to FIGS. 2 through 9. In this respect, the above description applies. It is sufficient to only point out the differences of the third embodiment.

The control member of the third embodiment is comprised of a push member 70 which is longitudinally movable in the sense of double arrow 75. The push member 70 is longitudinally guided in a partial profile 65 of the support 15 and is force-loaded according to the force arrows 76, 77 illustrated in FIGS. 11 and 14. This is realized by two independent forces of which one force load 76 acts in the direction of the closed position 20 and the other 77 in the direction of the open position 20' of the respective modular unit. The two forces 76, 77 act in opposite directions onto the push member 70.

These forces 76, 77 generate two force storage device 78, 79 which are comprised of two coil-shaped pressure springs in this configuration. The push member 70 is divided into two sections 71, 72, i.e., a rod part 71 and a toothed rack support 72. The rod part 71 penetrates the interior of the coil of the two pressure springs 78, 79. The push member 70 has two stops 73, 74 which can be entrained and between which the two force storage devices 78, 79 are arranged. These movable stops are comprised of an end disc 73 at the upper rod end and an end flange 74 at the lower rod end. These movable stops 73, 74 have correlated therewith stationary stops 83, 84 arranged within the support 15 which in the present situation belong to a guide member 82. The guide member 82 is comprised of a penetration 81 which is penetrated by the rod portion 71 of the push member 70. The stationary stops 83, 84 are formed by two oppositely positioned end faces of the guide member 82.

As already mentioned above, in the closed position 20 of the modular unit of FIG. 11 the force load 76 generated by the upper pressure springs 78 is effective; the lower pressure springs 79 is completely relaxed. In the closed position 20 the upper pressure spring 78 is compressed between the movable stop 73 and the stationary stop 83. In FIG. 11, the effective length 69 of the lower pressure spring 79 in the relaxed state is smaller than the spacing 67 of the stops 74, 84 correlated with this spring 79. Therefore, a free stroke 86 for the lower spring 79 remains in the closed position 20. Upon pivoting 48 of the modular unit into the first intermediate position illustrated in FIG. 12, the force 76 exerted by the upper spring 28 is reduced because the push member 70 is lifted by means of a linkage 72, 64. This linkage is comprised of a linkage part in the form of a tooth segment 64 provided on the lower arm area 25 which engages the tooth rack support 72 of the push member 70. The lower spring 79 is still relaxed even though the remaining rest of the free stroke 86 has already been reduced. In the angle area of the pivoting movement 48 between FIGS. 11 and 12, the force load 76 acts as an opening aid for the glass pane 21 wherein the force storage device 78 is increasingly released. This changes only during the course of the further opening pivot movement 48 up to the further intermediate position of the modular unit illustrated in FIG. 13.

Figure 13:
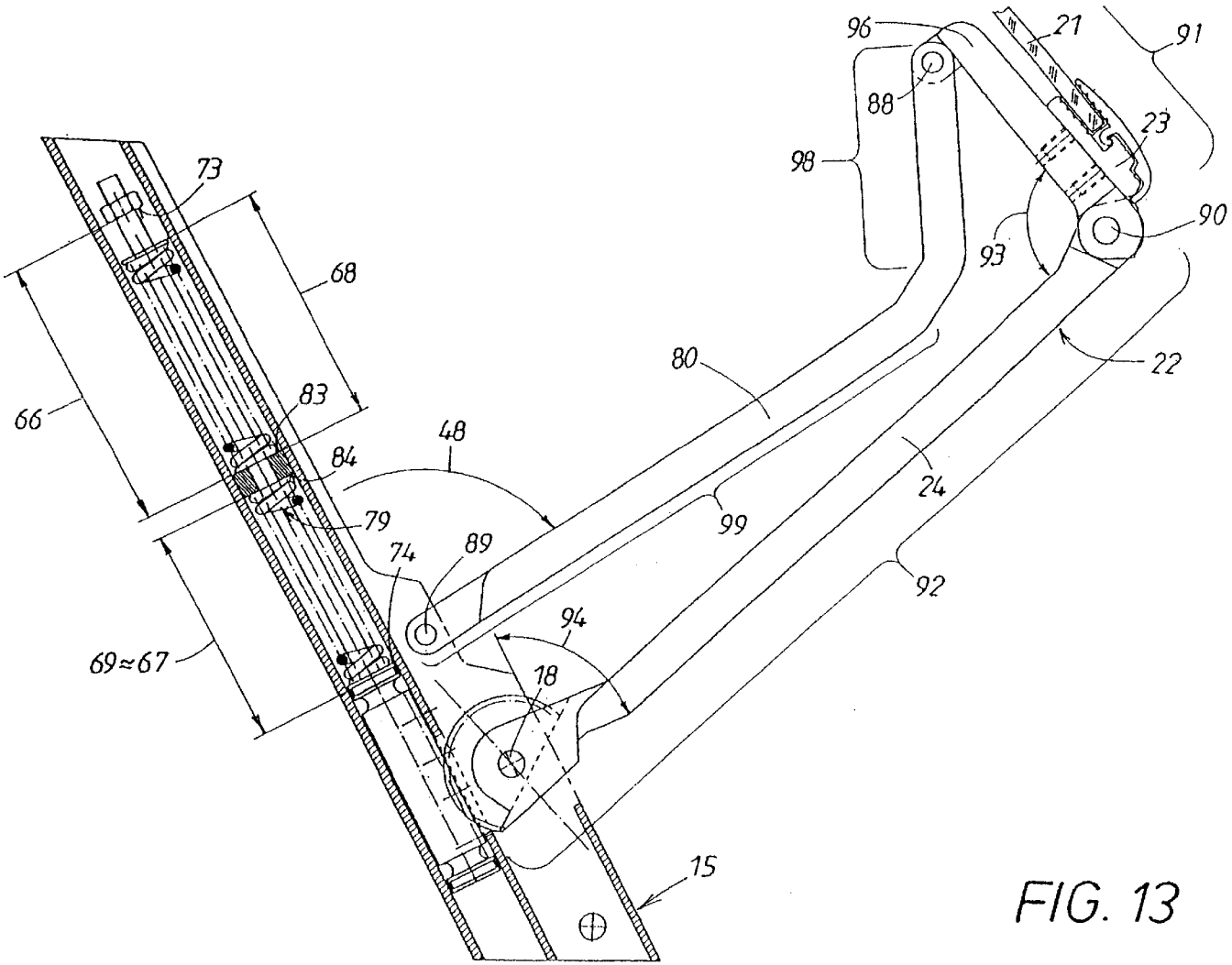

In FIG. 13 the spacing 66 between the movable and the fixed stops 73, 83 has already increased by an amount corresponding to the effective length 68 of the upper spring 78 in the relaxed state. There is no upper force load. In the case of the lower pressure spring 79, there may be present a borderline situation where the corresponding spacing 67 between the two stops 74, 84 corresponds approximately to the already described effective length, 69 of this lower spring 79 in the relaxed state. Accordingly, the lower force load is not yet active. In this phase of the pivot movement 48, the center of gravity of the modular unit may be moved substantially at the same level so that, in this pivot movement phase a manual force application for moving the glass pane 31 is not required. This changes only upon transition into the fully open position 20' of the modular unit.

Figure 14:
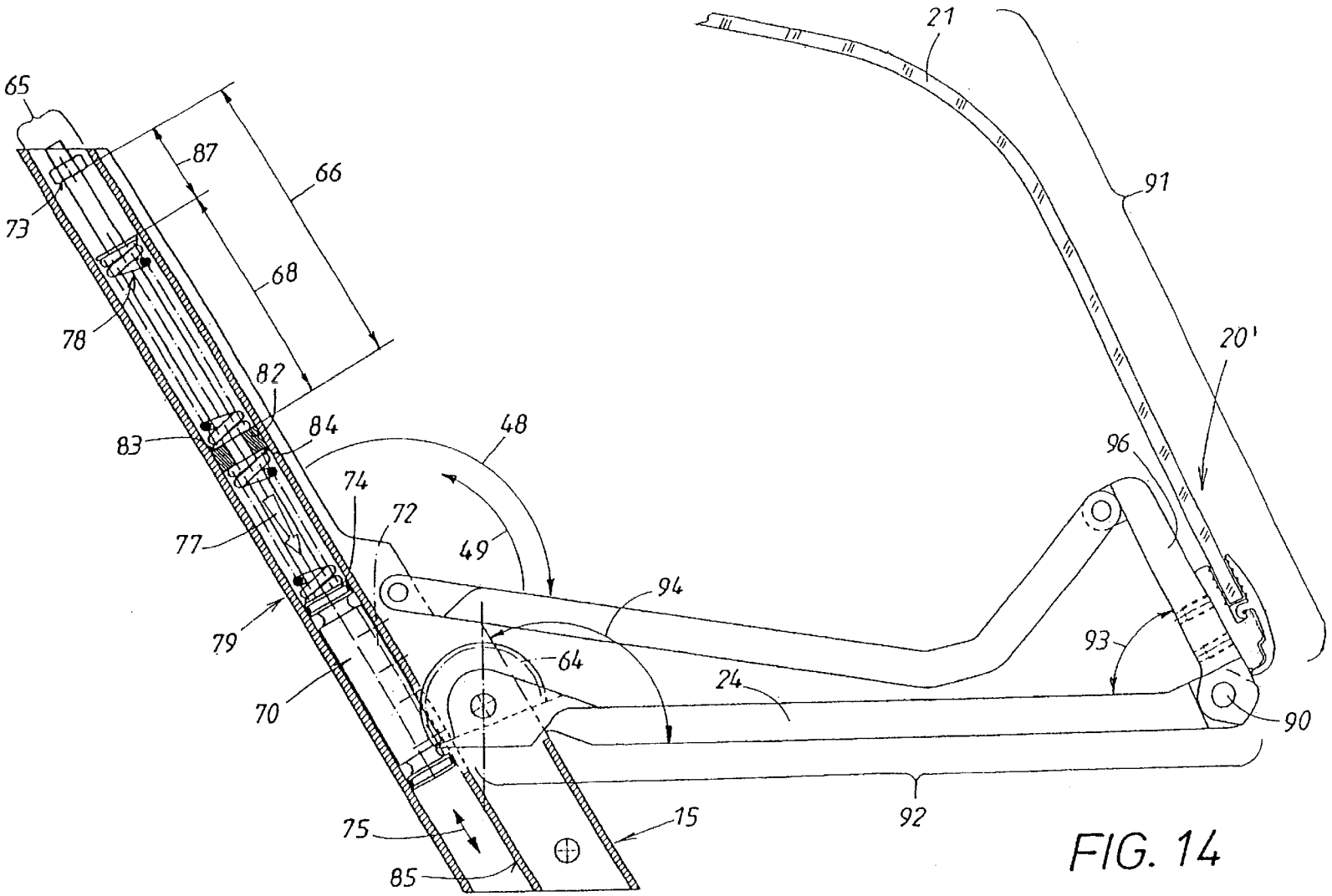
FIG. 14 shows the fully open position of the modular unit of the third embodiment of the counter according to the invention.

In FIG. 14 the arm 24 is in its fully pivoted open position relative to the support 15. Via the linkage 64, 72, the push member 70 has been moved into its axial end position where the stops 73, 83 correlated with the upper pressure spring 78 have their maximum spacing 66. Accordingly, in analogy to FIG. 11, a large free travel stroke 87 remains before the effective length 68 of this spring 78 in the relaxed position. The lower spring 79 is however compressed between its two stops 74, 84 and exerts a great force load 79 onto the push member 70. The residual pivot movement of the pivot movement 48 between FIG. 13 and FIG. 14 has charged the force storage device 79. The last phase of the pivot movement 48 has thus been dampened.

Figure 12:
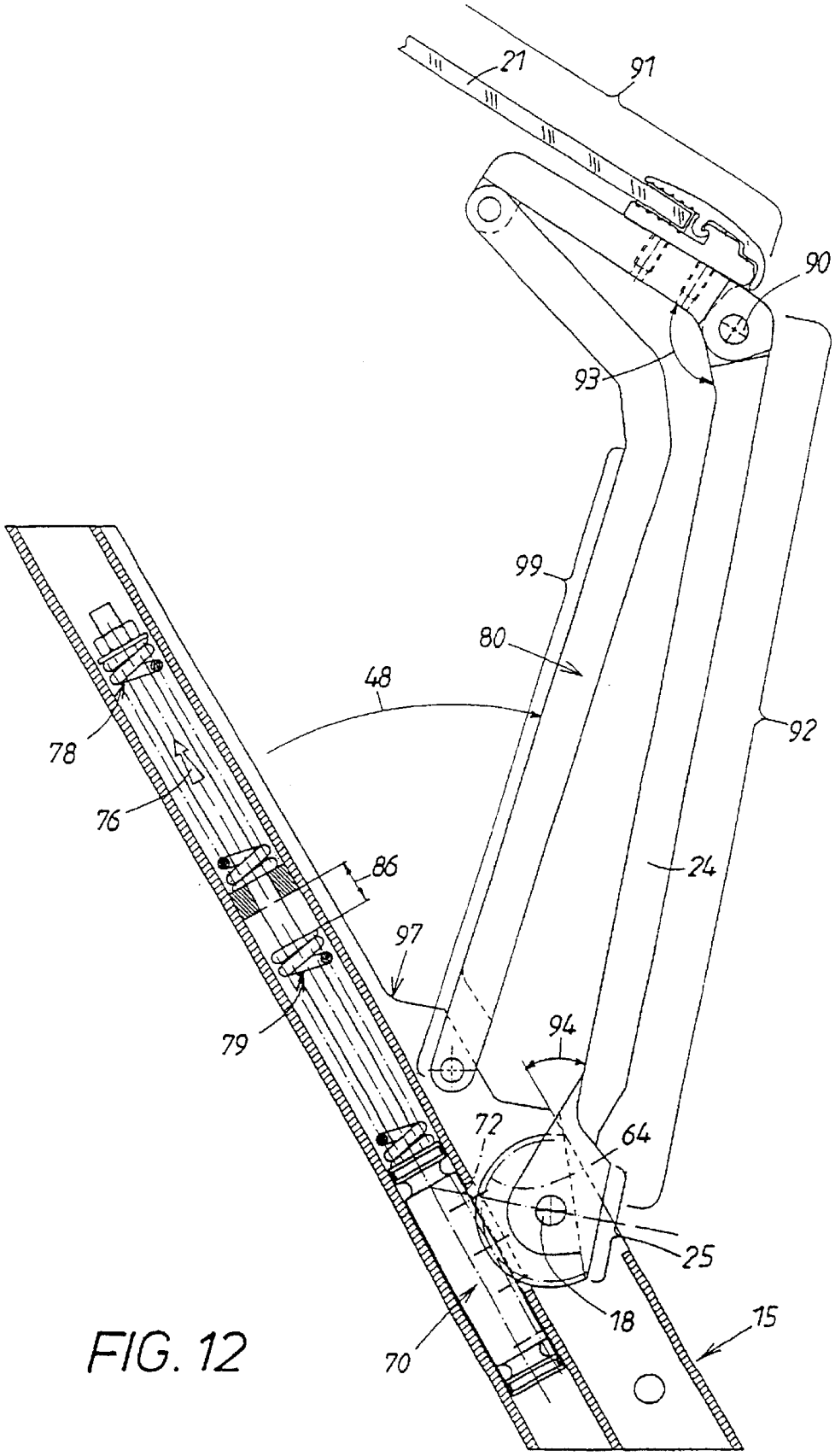
FIGS. 12+13 show intermediate positions of the modular units during pivoting in the direction of the fully open position of the modular unit of the third embodiment of the counter according to the invention.

When, based on the open position 20' of the modular unit in FIG. 14, the glass pane 21 is manually moved back, the closing movement, illustrated in FIG. 14 by the arrow 49, occurs via the intermediate positions of FIGS. 13 and 12 and the closed position 20 of FIG. 11 is reached. In the first phase of this closing movement 49 the force storage device 79 is relaxed so that a closing aid results for the manual movement of the glass pane 21. During the longitudinal movement 75 not only the afore described guide member 82 is effective as a guide but also the inner surfaces 85 of the aforementioned partial profiled section 65 of the support 15. Areas of the circumferential surfaces of the toothed rack support 72 of the push member 70 glide on these inner surfaces 85.

As already mentioned above, a special feature of the invention, explained in regard to the third embodiment of FIGS. 10 through 14, is that the corresponding modular unit is comprised of two oppositely movable partial modular units 91, 92 which will be explained with the aid of FIG. 13. The two partial modular units 91, 92 are connected to one another by a horizontal rotary axis 90 wherein the degree of its rotation is determined by a guide member 80. This guide member 80 controls the rotation of the one partial modular unit 91 illustrated by the rotary angle 93 in FIG. 13 relative to the other 92 as a function of the respective pivot position of this second partial modular unit 92 relative to the support 15. This pivot position can be described with the aid of the pivot angle 94 illustrated in FIG. 13 of the arm 24 of the joint member belonging to this second partial modular unit 92. Therefore, a force control of the glass pane 21 determined by the arm 24 and the guide member 80 is provided. The effect of this measure can be seen in FIG. 10.

In the open position 20' of FIG. 10, the glass pane 21 is arranged with its free edge zone 95 closely above the upper support end 16. In the present case, the glass pane 21 is a so-called "panoramic glass pane" which, as illustrated by the dash-dotted line of FIG. 10, in the closed position 20 has an arc-shaped transition between a horizontal glass pane area and a slanted, substantially planar front area of the glass pane. This front area includes the aforementioned free edge zone 95. In the open position 20 of FIG. 10, with a suitable configuration of the guide member 80 to be described in the following in more detail, the edge area 95 can approximately extend horizontally and can cover partially, like a roof, the support surface 13 of the body 11 of the counter. In the open position 20' the free glass pane edge has reached an end position 26' which can be determined substantially by the upper support end 16. In this embodiment, the counter has a very pleasing, elegant appearance even in the open position wherein the edge area 95 can provide the aforementioned spit protection. This effect can be achieved by the following configuration of the modular unit 91, 92.

As illustrated in FIG. 13, the first partial modular unit 91 includes, in addition to the glass pane 21 and the securing means 23 for the glass pane, also a head piece 96 of the joint member 22. These components 21, 23, 96 are fixedly connected with one another within the partial modular unit 91. This first partial modular unit 91 will be referred to in the following as "partial modular unit on the glass pane side". The glass pane-side partial modular unit 91 is movably connected with the second partial modular unit 92 by means of a horizontal rotary axis 90. The second partial modular unit 92 includes the arm 24 of the joint member 22 which at its lower arm area has the already mentioned pivot axis 18 for the entire modular unit. This second partial modular unit 92 in the following is referred to as the "axis-side partial modular unit". The modular units 91, 92 of this third embodiment differ from the modular unit of the afore described two embodiments of the invention in that the joint member 22 is divided by the rotary axis 90 into two partial members 96, 24 which are movable relative to one another: they comprise the head piece 96 belonging to the glass pane-side partial modular unit 91 and the arm 24 which belongs to the axis-side partial modular unit 92.

The guide member 80 which is used for the force control of the angle of rotation 93 is comprised in the present situation of a connecting rod whose one end at 88 is connected to the head piece 96 of the glass pane-side partial modular unit 91 connected to the glass pane while the other end of the rod is connected stationarily by means of a joint 89 with the counter 11 for which purpose in the present situation this connecting location 89 is located on the support 15. The connecting rod 80 is moreover angled in the present case and divides the rod into two legs 98, 99. The connecting rod 80, on the one hand, and the arm 24, on the other hand, form together with their connecting locations 98, 99 or axes 90, 18 a parallelogram linkage between the glass pane 21 and the body 11 of the counter, respectively, its support 15. Accordingly, in any phase of the pivot movement 48 a defined rotary angle 93 results between the two partial modular units 91, 92.

In the closed position 20 of the modular unit according to FIG. 11 a maximum rotary angle 93 between the head member 96 and the arm 24 of the joint member 22 is present. The arm 24 extends substantially parallel to the support 15 and engages in this connection a profiled cutout 96 of the support 15 which can be seen better in FIG. 12. The pivot angle of the arm 24 relative to the support is at a minimum, i.e., it is zero. The outer leg portion 98 of the angled connecting rod 80 extends parallel to the head piece 96 while the inner rod leg 99 is positioned parallel to the arm 24. Between.the modular units 96, 98, on the one hand, and the modular units 24, 99, on the other hand, contact is therefore possible. The cutout 97 in the support 15 is dimensioned such that in the closed position 20 of FIG. 11 the inner rod leg 99 and the arm 24 are positioned flush within the cross-section of the support 15.

When pivoting open (48) the modular unit 91, 92, the rotary angle 93 between the partial modular units 91, 92 decreases with increasing pivot angle 94. The free end 26 of the class pane moves therefore not on such a large circular arc as in the previous two embodiments of FIG. 2 but moves on a more flat curved path until finally the already described positioned 26' of FIG. 10 is reached in the fully opened position 20' of the modular unit. This open position 20' is illustrated in, FIG. 14. Accordingly, a maximum pivot angle 94 is provided while the rotary angle 93 between the two partial modular unit 91, 92 has reached the smallest value. In the closed position 20 of FIG. 11 the rotary angle 93 may be approximately 120° while in the open position 20' of FIG. 14 it is only approximately 65°. Accordingly, the pivot movement 48 of the entire module unit 91, 92 is superimposed by a return rotation of the free end of the glass pane from the position 26 into the position 26' of FIG. 10. This return rotation is the difference between the original rotational angle 93 of FIG. 11, on the one hand, and the final rotary angle of FIG. 14, on the other hand.

The guide member 80 could also be embodied in a different way. It could be comprised of at least one pair of telescopic members which make it thus longitudinally movable. These telescopic members can be force-loaded in the insertion direction or in the extension direction. This force load can be additive to the afore described force load 76, 77 of the slide 70 or can replace it completely or partially. The free ends of the members of such guide member are connected analogously, on the one hand, to the partial modular unit 91 of the glass pane and, on the other hand, on the body 11 of the counter or on its supports 15 and are moveably supported thereat as in the second embodiment at 44, 77.

List of Reference Numerals

| | |
|---|---|
| 10 | counter according to the invention |
| 10' | counter according to the prior art |
| 11 | body of counter of 10 or 10' |
| 12 | customer side of 10, 10' |
| 13 | support surface of 10, 10' |
| 14 | lower end of 15 |
| 15 | support |
| 16 | upper end of support 15 |
| 17 | hollow profile of 15; rectangular profile |
| 18, 18' | pivot bearing of 22 or 22', horizontal pivot axis |
| 19, 19' | pivot angle of 22 or 22' |
| 20 | modular unit (in closed position); or rigid modular unit (FIGS. 1 through 9) |
| 20' | open position of 20 |
| 20" | intermediate position of 20 |
| 21 | glass pane of 20 |
| 22 | joint member of 10 |
| 22' | joint member of 10, swivel head |
| 23 | securing means for 21 on 22 or 22' |
| 24 | extension arm of 22, arm of 22 |
| 25 | lower arm area of 24, area of the lower arm end |
| 26 | free end of the glass pane of 20 (initial position) |
| 26' | end position of 26 in 20' (FIGS. 1, 2, 10) |
| 27, 27' | center of gravity of 20 or 20' |
| 28, 28' | travel distance between 26, 26' at 10, 10' |
| 29 | front edge of counter of 11 |
| 30 | rod-shaped dampening device (FIG. 3) |
| 31 | stationary upper rod end of 30 |
| 32 | movable lower rod end of 30 |
| 33 | support nose on 22 |
| 34 | upper end face of 15 |
| 35 | rear profile wall of 15 |
| 36 | cutout in 15 at 35 |
| 37 | end portion of 15 |
| 38 | support surface for 22 (FIGS. 2, 6) |
| 39 | outer surface of 35 (FIG. 6) |
| 40 | hollow profile interior of 15 |
| 41 | end piece of 24 |
| 42 | step-shaped shoulder of 24 (FIG. 3) |
| 43 | connecting location of 51 for 25 (FIG. 7) |
| 44 | stationary point of attack of 51 in 15 (FIG. 7) |
| 45 | push rod of 51 (FIG. 7) |
| 46 | longitudinal movement of 45 relative to 44 (FIG. 9) |
| 47 | shoulder on 45 for 44 (FIG. 7) |
| 48 | arrow of opening movement (FIG. 7) |
| 49 | arrow of closing movement (FIG. 9) |
| 50 | sliding block guide between 55, 52 (FIG. 7) |
| 51 | rod-shaped control member, force storage device, opening aid |
| 52 | rod-shaped control member, force storage device, closing aid |
| 53 | point of attack of 52 on 25 (the initial position) |
| 53' | end position of 53 (FIG. 9) |
| 53" | intermediate position of 53 (FIG. 8) |
| 54 | stationary lower connecting location of 52 in 15 (FIG. 7) |
| 55 | linkage between 25, 52, lever (FIG. 7) |
| 56 | pivot pin of 50 |
| 57 | slotted hole of 50 |
| 58 | minimal insertion length of 51 (FIG. 7) |

-continued

List of Reference Numerals

| | |
|---|---|
| 58' | maximum extension length of 51 (FIG. 9) |
| 58" | intermediate length of 51 (FIG. 8) |
| 59 | maximum extension length of 52 (FIG. 7) |
| 59' | minimum insertion length of 52 (FIG. 9) |
| 60 | free spacing between 44, 57 at 20" (FIG. 8) |
| 61 | force arrow of 51, spring force |
| 62 | force arrow of 52, spring force |
| 63 | arrow of initial movement of 43 (FIG. 8) |
| 64 | second linkage part, tooth segment of 24 (FIG. 11) |
| 65 | partial profile 15 (FIG. 11) |
| 66 | spacing between 73, 83 (FIG. 14) |
| 67 | spacing between 74, 84 (FIG. 11) |
| 68 | effective length of 78 in the relaxed state (FIG. 14) |
| 69 | effective length of 79 in the relaxed state (FIG. 11) |
| 70 | push rod, rod |
| 71 | first section of 70, rod part |
| 72 | second portion of 70, toothed rack support, second linkage part |
| 73 | movable stop on 70, end disc |
| 74 | movable stop on 70, end flange |
| 75 | double arrow of longitudinal movement of 70 |
| 76 | arrow of force load of 78 |
| 77 | arrow of force load of 79 |
| 78 | upper force storage device, pressure spring |
| 79 | lower force storage device, pressure spring |
| 80 | guide member, connecting rod (FIGS. 11 through 14) |
| 81 | penetration in 82 |
| 82 | guide member for 70 |
| 83 | stationary stop on 15, upper surface of 82 |
| 84 | stationary stop on 15, lower surface of 82 |
| 85 | guiding-active inner surfaces of 65 for 70 (FIG. 14) |
| 86 | free stroke for 79 at 20 (FIG. 11) |
| 87 | free stroke for 78 at 20' (FIG. 14) |
| 88 | upper entrained connecting location of 80 |
| 89 | lower stationery connecting location of 80 |
| 90 | horizontal rotary axis between 91, 92 (FIGS. 11 through 14) |
| 91 | partial modular unit (FIG. 13) at the glass pane side |
| 92 | partial modular unit (FIG. 13) at the axis |
| 93 | rotary angle between 91, 92 (FIG. 13) |
| 94 | pivot angle between 24, 15 (FIG. 13) |
| 95 | free edge zone of 21 (FIG. 2) |
| 96 | head piece of 22 at 91 (FIG. 13) |
| 97 | recess of 15 for 24, 99 (FIG. 12 and 11) |
| 98 | outer rod leg of 80 |
| 99 | inner rod leg of 80 |

What is claimed is:

1. Counter (10) for presenting and/or selling goods, comprising a body (11) of the counter which has a support surface (13) for the goods, with several (17) supports (15) which with their lower end (14) are fastened on the body (11) of the counter, with at least one joint member (22) on each support (15) connected by means of a pivot bearing (18) with the support (15), projecting at the support end (16) and having securing means (23) for a glass pane (21) having correlated therewith several supports (15), wherein the joint members (22) with the glass pane (21) fastened on its securing means (23) form a modular unit which is pivotable about a horizontal axis defined by the pivot bearings (18) between a closed position (20) covering the goods on the support surface (13), on the one end, and an open position (20') allowing access to the goods, on the other hand, wherein the joint member (22) has an extension arm (24) which—viewed in the closed position—extends in the longitudinal direction of the support (15), wherein upon pivoting of the modular unit from its closed position (20) into its open position (20') the center of gravity of the modular unit is moved from an initial position (27) located on one side relative to the pivot axis (18) into an end position located on the oppositely positioned side of the pivot axis (18), and with a parallelogram linkage (80, 24) between the glass pane (21) and the body (11) of the counter which is comprised of a pivot arm (24) and a guide member (80), wherein the one end of the pivot arm (24) and of the guide member (80), at a spacing to one another, are connected (88, 90) to the glass pane (21) and are movable together with the glass pane (21), and the other end of the pivot arm (28) and of the guide member (80), also at a spacing to one another, are connected stationarily on the support (15) of the body (11) of the counter in a pivotal way (18, 89), wherein the course of the pivot movement (48, 49) of the glass pane (21) is determined by control members which are comprised of a force-loaded push member (70) and are guided along the support (15), that between the pivot arm (24) and the push member (70) a linkage (64, 72) is arranged which converts the pivot movement (48, 49) of the linkage arm (24) into a longitudinal movement (75) of the push member (70), and that the push member (70) is loaded by two independent forces (76, 79), wherein one force load (76) acts in the closed position (20) of the glass pane (21) and the other (77) acts in its open position (20') onto the push member (70).

2. Counter according to claim 1, wherein the two forces (76, 77) act in opposite direction and—during pivoting (48, 49) of the glass pane (21)—phase-displaced relative to one another onto the push member (70).

3. Counter according to claim 1, wherein the push member (70) has two force storage devices (78, 79) correlated therewith, that the push member (70) for engagement of the two force storage devices (78, 79) has two movable stops (73, 74) which, upon longitudinal movement (75) of the push member (70), are moved therewith, and that for engagement of the two force storage devices (78, 79) on the support (15) two stationary stops (83,84) are provided.

4. Counter according to claim 3, wherein the two force storage devices (78, 79) are arranged in the support (15) above the pivot bearing (18) of the pivot arm (24).

5. Counter according to claim 3, wherein the two force storage devices (78, 79) in the relaxed state have an effective length (68, 69) which—in the open or closed position (20; 20')—is smaller than the spacing (66, 67) between the corresponding movable and stationary stops (73, 83; 74, 84), respectively.

6. Counter according to claim 3, wherein the two force storage devices are comprised of two coil-shaped pressure springs (78, 79) and that the push member is comprised of a rod (70, 71), wherein the rod (71) penetrates the interior of the coil of the two pressure springs (78, 79), that the two stationary stops (83, 84) are arranged between the two pressure springs (78, 79), and that the two movable stops (73, 74) enclose the two pressure springs (78, 79) therebetween and are located on the upper or lower end of the rod (70).

7. Counter according to claim 3, wherein the stationary stops are formed by the two oppositely positioned surfaces (83, 84) of a guide member (82), and that the guide member (82) has a penetration (81) penetrated by the rod (71).

8. Counter according to claim 1, wherein the inner surfaces (85) of the profile of the support (15) themselves and/or guide members (82) provided thereat serve for longitudinal guiding (75) of the push member (70) or the rod (71).

9. Counter according to claim 1, wherein the linkage, on the one hand, is comprised of a tooth rack portion (72) on the push member (70) and, on the other hand, of a tooth segment (64) in the area of the lower arm end (25) of the joint member (22).

* * * * *